United States Patent [19]

O'Connor

[11] 4,343,053

[45] Aug. 10, 1982

[54] DISPOSABLE BEDPAN LINER

[76] Inventor: Nicholas E. O'Connor, 18 Cramond Rd., Chestnut Hill, Mass. 02167

[21] Appl. No.: 168,328

[22] Filed: Jul. 11, 1980

[51] Int. Cl.[3] ..... A61G 9/00

[52] U.S. Cl. ..... 4/452; 4/144.2; 4/315; 4/483; 4/484; 4/DIG. 18; 128/283

[58] Field of Search ..... 4/449–458, 4/479, 483, 484, 144.1, 144.2, 242–245, DIG. 18, 300.3, 315, 416, 480, 481, 580, 604; 128/283, 295, 760, 761

[56] References Cited

U.S. PATENT DOCUMENTS

| | | | |
|---|---|---|---|
| 195,521 | 9/1877 | Merriman | 4/455 |
| 2,147,174 | 2/1939 | Richard | 4/450 |
| 2,320,845 | 6/1943 | Bolton . | |
| 2,537,504 | 1/1951 | Anderson | 4/484 |
| 2,837,094 | 6/1958 | Cowles | 128/283 |
| 3,061,840 | 11/1962 | Presseisen . | |
| 3,066,315 | 12/1962 | Huber . | |
| 3,115,644 | 12/1963 | Bloodworth . | |
| 3,249,950 | 5/1966 | Wilson . | |
| 3,377,631 | 4/1968 | Whitney . | |
| 3,546,716 | 12/1970 | Laumann . | |
| 3,588,921 | 6/1971 | Nagel | 128/283 X |
| 3,609,777 | 10/1971 | Avoy . | |
| 3,763,502 | 10/1973 | Laumann . | |
| 3,777,317 | 12/1973 | Hobom . | |
| 3,906,555 | 12/1975 | Scott et al. . | |
| 3,936,890 | 2/1976 | Oberstein . | |
| 3,942,196 | 3/1976 | Mills . | |
| 3,992,729 | 11/1976 | Mills . | |
| 4,011,606 | 3/1977 | Scrafield et al. . | |
| 4,136,798 | 1/1979 | Oberstein | 4/452 X |

FOREIGN PATENT DOCUMENTS

| | | |
|---|---|---|
| 680454 | 2/1964 | Canada . |
| 774792 | 1/1968 | Canada . |
| 800204 | 12/1968 | Canada . |
| 811355 | 4/1969 | Canada . |
| 819353 | 8/1969 | Canada . |
| 945303 | 4/1974 | Canada . |
| 972904 | 8/1975 | Canada . |
| 1002253 | 12/1976 | Canada . |
| 1004407 | 2/1977 | Canada . |

*Primary Examiner*—Stuart S. Levy

*Attorney, Agent, or Firm*—Cushman, Darby & Cushman

[57] ABSTRACT

A disposable bedpan liner in accordance with one aspect of the invention includes an elongated liquid impervious flexible sleeve having oppositely disposed open ends. The mouth of the liner is defined at one end of such sleeve and has first handle means associated therewith to allow the mouth to be opened and brought into juxtaposition with the seat portion of a bedpan and to be closed after use by a patient. A second handle means is connected adjacent the other of the sleeve ends so that when the sleeve is folded over on itself and the first and second handle means are brought and held together, a purse-like structure is provided. The thus folded over sleeve forms a pouch for containing waste matter with release of the second handle means allowing the sleeve to unfold and the waste matter to pass outwardly through the above-noted other one of the open ends.

12 Claims, 9 Drawing Figures

DISPOSABLE BEDPAN LINER

BACKGROUND OF THE INVENTION

This invention relates to improvements in disposable liners for bedpans and the like.

Hospital authorities have long recognized the importance of minimizing to the greatest degree possible the risk of cross-infection occurring between patients or between patients and nursing staff. One source of cross-infection which exists to the present day arises from the distribution to patients of bedpans and the handling of these articles by the nursing staff or attendants both before and after use. Contamination of bedpans obviously occurs both from the waste products they receive and from physical contact with users. The equipment commonly utilized to wash such receptacles is not always effective in removing the resultant contamination and/or such equipment is not always utilized in the most effective manner by the attendants with the result being that an undesirably high percentage of the articles in question are left in a condition which is far from sterile. The problem is compounded by the fact that a conventional bedpan, by virtue of its inturned seat portion, has a surface which is completely hidden from view which complicates the cleaning procedure. In cases where sterile precautions are in effect, the attendants may be faced with the unpleasant task of washing such receptacles by hand utilizing suitable disinfectants thereby to supplement the routine mechanical cleaning procedure commonly employed. It can thus be said that the overall procedure involves the use of a considerable amount of manual handling and attendant time loss coupled with a great deal of wastage of hot water and/or disinfectant materials all of which contribute to higher hospital operating costs.

In an effort to alleviate the above difficulties, the prior art has provided various forms of disposable bedpans and liners many of which are made of fibrous pulp materials. Many of these designs have presented problems in terms of disposal in that they occasionally fail to disintegrate sufficiently rapidly as to avoid clogging of the drainage systems and in other cases difficulties have been encountered in providing adequate structural strength. Certain other designs of bedpan liners require the use of a specially designed bedpan which is a serious drawback in that few hospitals wish to be faced with the expense of replacing their inventory of bedpans to accommodate a particular form of bedpan liner. In addition, most if not all of the prior designs present problems in terms of the disposal of the collected waste from the liner; excessive manual manipulation of the liner is required with an attendant risk of spillage of the contents and/or contamination of the attendant's hands or garments.

SUMMARY OF THE INVENTION

It is a basic object of the present invention to alleviate to a very substantial degree the various problems noted above and to provide an improved form of bedpan liner which is useable with conventional hospital bedpans and the like and which, moreover, is very inexpensive to manufacture, which substantially eliminates the possibility of cross-infection occurring as a result of its use and which provides for clean and efficient disposal of waste matter therefrom with a minimum amount of time and effort expenditure on the part of the attendants.

A disposable bedpan liner in accordance with one aspect of the invention includes an elongated liquid impervious flexible sleeve having oppositely disposed open ends. The mouth of the liner is defined at one end of such sleeve and has first handle means associated therewith to allow the mouth to be opened and brought into juxtaposition with the seat portion of a bedpan and to be closed after use by a patient. A second handle means is connected adjacent the other of the sleeve ends so that when the sleeve is folded over on itself and the first and second handle means are brought and held together, a purse-like structure is provided. The thus folded over sleeve forms a pouch for containing waste matter with release of the second handle means allowing the sleeve to unfold and the waste matter to pass outwardly through the above-noted other one of the open ends.

Preferably the first handle means includes a pair of handles movable toward and away from one another to provide the open and closed positions of the liner mouth.

As a further feature of the invention each of the pair of handles has a respective marginal section connected thereto with said one end of the sleeve being connected to the marginal seat sections to further define the mouth of the liner. These marginal seat sections, in the open condition of the mouth, are arranged so as to overlie the seat portion of the bed pan.

Each of the marginal seat sections is preferably of a generally C-shaped configuration with such sections being hingedly attached together so that in the open position they define a generally oval outline shape.

As a further feature of the invention, the sleeve includes a flap which extends outwardly of said other open end in overlapping relation to the second handle means thereby to protect the latter from contact with waste matter passing outwardly of the open end during drainage of the waste matter into a suitable receptacle after use by the patient.

The sleeve is preferably provided with a plurality of longitudinally extending pleats which act to allow the sleeve to bellow outwardly into the interior of a bedpan when in use.

The sleeve is also preferably tapered downwardly in size from the mouth toward the opposite open end thereof which tapered design facilitates the emptying of the contents of the sleeve into a receptacle and also serves to conserve materials.

In the preferred form of the invention, the above-noted handles are formed integrally with their associated marginal seat sections from a relatively thick but flexible pliable sheet of plastic material. That surface of the sheet material which comes into contact with the patient is preferably smooth while the opposite surface is roughened to resist slippage relative to the bedpan during use. The sleeve itself is typically made from a relatively thin pliable plastic sheet.

Additional features and advantages of the present invention will become apparent from the following description of a preferred embodiment of same.

BRIEF DESCRIPTION OF THE DRAWINGS

In drawings which illustrate an embodiment of the invention.

DETAILED DESCRIPTION OF THE PREFERRED EMBODIMENT

Figure 1:
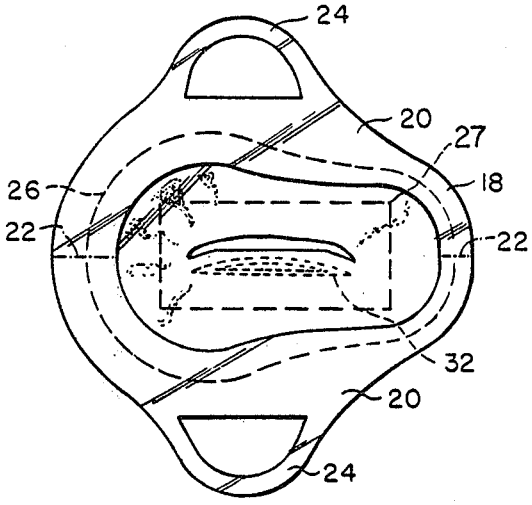
FIG. 1 is a plan view of the combination handle-marginal seat section arrangement.

Referring now to the drawings, the disposable bedpan liner 10 includes an elongated liquid impervious flexible sleeve 12 of a relatively thin plastic sheet material. This sleeve is provided with oppositely disposed open ends 14 and 16, the mouth of the bedpan liner being defined at end 14 while the exit from the bedpan liner is defined at end 16.

The mouth end 14 of the flexible sleeve is provided with a combination handle and marginal seat 18 as best seen in FIG. 1. The handle and marginal seat arrangement 18 includes opposed marginal seat sections 20, each being of a generally C-shaped configuration, which seat sections 20 are hingedly connected together along score lines 22 which allow for ease of folding, with the seat sections 20 together defining, in the open position, a generally oval outline shape. The outline shape is, of course, of a configuration designed to accommodate the bedpan design with which the liner is to be used. Each of the above-noted seat sections has a respective handle 24*a*, 24*b* integrally formed therewith whereby to permit the attendant to readily grasp the two handles with one hand when the arrangement is folded together along the above-noted score lines 22.

Figure 2:
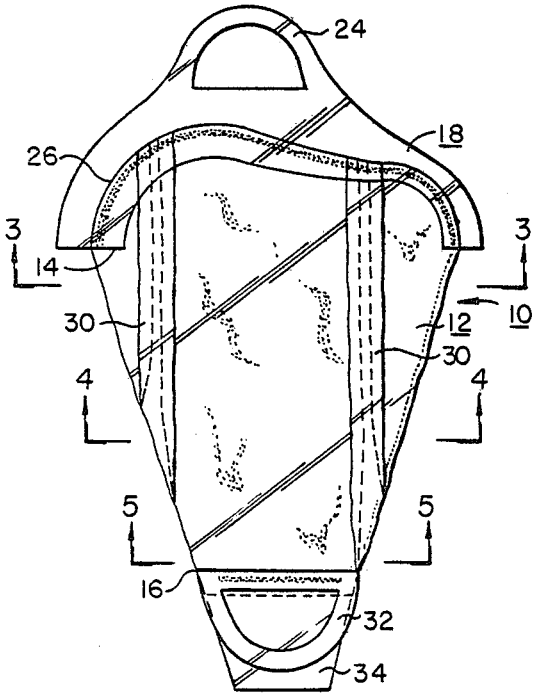
FIG. 2 is a side elevation view of the disposable bedpan liner.
Figure 3:
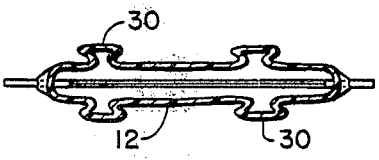
FIGS. 3, 4 and 5 are sectional views of the sleeve taken along lines 3—3, 4—4 and 5—5 respectively of FIG. 2.
Figure 4:
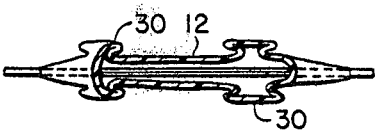
Figure 5:
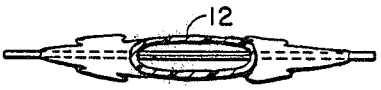

The above-noted end portions 14 of sleeve 12 is securely bonded, as by heat sealing, all about the inner peripheral portion of the handle and seat arrangement 18 as illustrated by the line 26 shown in FIGS. 1 and 2. Prior to the heat sealing operation, the sleeve 12 is pleated thereby to provide a plurality of longitudinally extending pleats 30 therein extending from adjacent the mouth 14 toward the opposite exit end 16. These pleats are clearly illustrated in FIGS. 2-4. These pleats allow the sleeve 12 to bellow outwardly into the interior of a bedpan during usage thereby to increase the effective capacity of the sleeve and to allow the same to be fitted into the interior of the bedpan just prior to use. It will also be clearly seen from FIG. 2 that the sleeve 12 is tapered downwardly in size from the mouth end 14 toward the exit end 16. This facilitates handling and assists the attendants in disposing of wastes without spillage as will be seen hereinafter.

It should be noted here that the above-described handle and marginal seat arrangement 18 is preferably made from a relatively thick sheet plastic material as, for example, low density polyethylene having a thickness of about 0.030 in. The required shape can be easily die cut from standard sheet material with a minimum amount of cost. The sleeve 12, as previously noted, can be made of a much thinner material thereby to save on manufacturing costs and to reduce the amount of storage space required; the thickness of the material from which sleeve 12 is formed is made just sufficiently thick as to avoid accidental rupture and spillage of contents during normal usage.

The exit end 16 of the sleeve is also provided with a handle 32 which is preferably made from the same stock material as is the handle and marginal seat arrangement 18. This handle 32 is firmly secured as by heat sealing to the sleeve immediately adjacent the exit end 16. With particular reference to FIG. 2 it will be seen that the sleeve 12 is provided with a flap 34 which extends outwardly of the exit end 16 in overlapping relation to handle 32. It will be seen hereinafter that this flap 34 protects the handle 32 and the attendant's hand from contact with waste matter passing outwardly of the exit end 16 when the sleeve is being emptied of its contents. This lower handle 32 is bonded to that surface of the tapered sleeve 12 which includes the above-noted flap 34.

Figure 6:
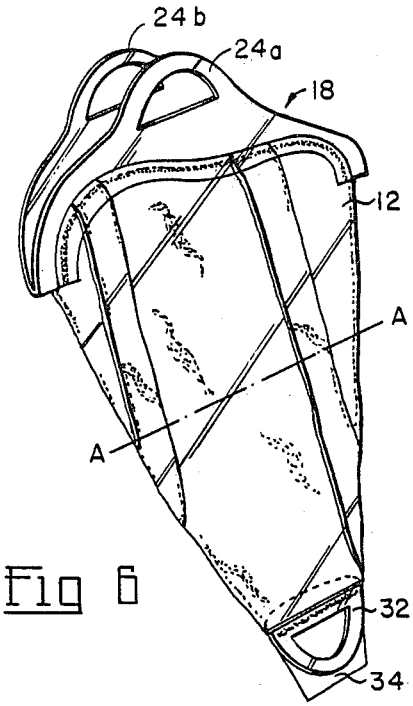
FIG. 6 is a perspective view of the bedpan liner illustrating the manner in which the sleeve is folded to form a purse-like arrangement.

The bedpan liner is initially packaged by the manufacturer with the sleeve 12 being folded about line A—A as shown in FIG. 6 with the lower handle 32 being swung around and positioned on top of the folded handle-marginal seat arrangement 18 with all of the handles 24*a*, 24*b* and 32 being aligned when the bedpan liner is in the folded condition. An absorbent paper liner is positioned in the upper half of the sleeve. The manufacturer may also conveniently include in this package a plurality of disposable paper wipes as well as disposable gloves for use in cases where the patient is on urine or stool precautions. Dip sticks may be included for doing various tests on the urine.

Figure 7:
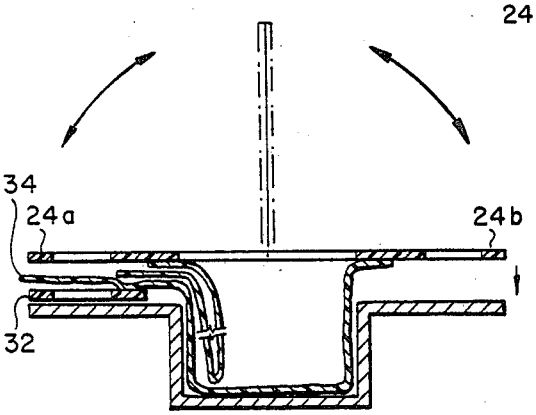
FIG. 7 is a somewhat diagrammatic transverse section through a bedpan with the disposable liner in place (not to scale)

In use, with reference to FIG. 7, the lower handle 32 and the upper handle 24*a* are brought together with the tapered sleeve 12 being positioned in the bedpan interior. The handle and marginal seat arrangement 18 is placed in the open position with the marginal seat sections 20 overlying the seat portion of the bedpan. An absorbent paper liner 27 may be positioned in the sleeve below the opening formed by the marginal seat sections 20. For convenience and to ensure a proper orientation in use of the device, the lower handle 32 and handle 24*a* can be kept together with a small easily rupturable paper loop (not shown).

Figure 8:
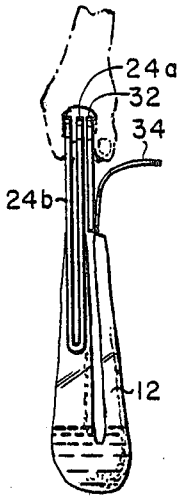
FIG. 8 is an end elevation view of the bedpan liner showing the sleeve folded over on itself and the several handles brought together and being carried as if it were a purse.
Figure 9:
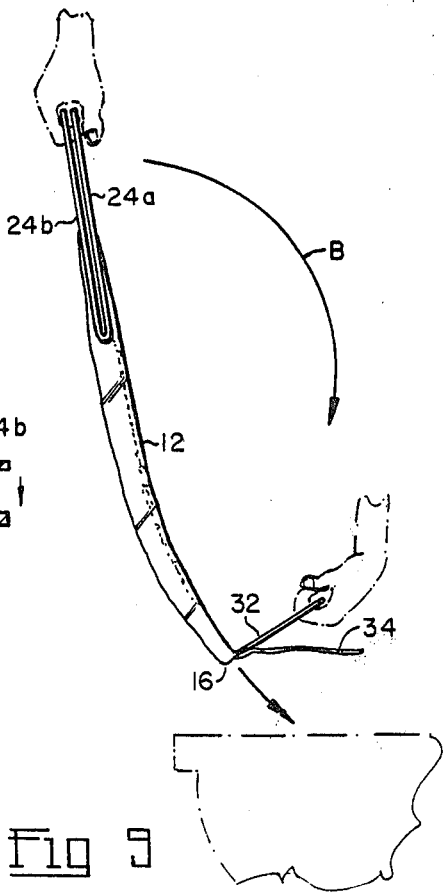
FIG. 9 illustrates the manner in which the sleeve is unfolded and the contents of the sleeve emptied into a suitable receptacle.

After use by the patient, handles 24*a*, 24*b* and the lower handle 32 are brought together and aligned with one another thereby to form a purse-like structure with the folded over sleeve 12 forming a pouch, with the entire liner being then lifted upwardly so that the sleeve 12 containing the urine and feces is removed from the bedpan. This purse-like arrangement is then carried away by the attendant in the manner illustrated in FIG. 8 to the hopper or other disposal location. The paper loop joining the lower handle 32 to the handle 24*a* is then easily broken and the lower handle is then swung downwardly as illustrated by arrow B in FIG. 9 to a lower position over the disposal hopper by virtue of which the contents of the sleeve, including the inner paper liner C, which was positioned in the sleeve prior to use, empties through the exit end 16 into the hopper at a controlled rate. It will be seen from FIG. 9 that the flap 34 protects the handle 32 and the attendant's hand from contamination.

The disposable liner is then folded and compressed and placed into a standard waste receptacle or a small plastic bag for odour control.

Numerous modifications and variations may be made within the scope of the present invention. As was noted previously, the surface of the handle and marginal seat arrangement 18 which contacts the patient may be made smooth to present a comfortable surface while the opposite surface which contacts the bedpan may be made relatively rough or pebbled to prevent slippage of assembly 18 over the bedpan surface.

The outline shape of the handle and marginal seat arrangement 18 can of course be varied to fit different standard makes of bedpans. The size and shape of the bedpan liner can be scaled down to accommodate pediatric bedpans or bedside and regular commodes.

The liner can also be scaled down and sized to fit children's commodes or standard training potties in the home and therefore do away with the necessity of parents cleaning the same. Thus, although for convenience the present specification makes reference to the use of the term "bedpan" it is to be understood that this invention is to cover the application of the disposable liner to other forms of containers as noted above. It will also be appreciated that the liner described herein can be gas sterilized and placed in regular commodes to collect sterile specimens as desired.

The sleeve 12 is preferably made of a transparent plastic thereby to allow direct inspection of the urine and/or feces by medical personnel. Lines or markings (not shown) may be provided on the sleeve 12 in suitable locations thereby to allow the volume of waste to be estimated.

The tapered design of the sleeve 12 allows for ease of emptying the contents of the sleeve into a hopper. Moreover, because of the design described above, the waste flows in one direction, entering at the mouth end 14 of the sleeve and ultimately passing through the relatively narrow exit end 16 thus minimizing tipping or spillage problems.

The disposable liner with handles as described allows for ease of carrying or transporting the waste material and minimizes the risk of spillage as compared to rigid bedpans. The bottom handle described above provides for controlled release of the contents of the sleeve into the hopper and the above-described flap at the exit end prevents contamination of the lower handle as well as the attendant's hand and clothing.

The liner can be hung on a coat hook and therefore several disposable liners (or a batch of same) can be transported at one time thus cutting down on attendant's time. The flexible nature of the handles allows the device to accommodate itself to different shapes of bedpans and furthermore after it is emptied it can be collapsed or folded up and put in a small plastic bag for odour-free waste disposal or alternatively placed in regular size waste cans.

The use of the inner paper liner assists in allowing solid wastes to slide out of the plastic liner without sticking to the sides. A deodorant may also be placed inside the polyethylene liner to decrease the amount of malodor associated with storage of the bags after usage.

The use of the disposable liner described above should lead to savings of time in that the attendant will only have to make one trip to dispose of waste matter. Secondly, the attendant will not have to spend any time cleaning the bedpan. Savings of money should occur in that there will be a decreased amount of space required for storing disposable rigid plastic bedpans and there will be no need for the large volumes of hot water necessary to wash the bedpans. Finally, with the use of this disposable liner the installation of large hoppers for emptying and cleaning bedpans becomes unnecessary.

I claim:

1. A disposable liner for bedpans and the like comprising an elongated liquid impervious flexible sleeve having oppositely disposed open ends; the liner having a mouth which is defined at one of said ends of said sleeve and having first handle means comprising a pair of handles movable towards and away from one another to provide the closed and open positions of the mouth of said liner and to allow the mouth of said liner to be closed after use by a patient, wherein each of said pair of handles has a respective marginal seat section connected thereto, with said one end of the sleeve connected to the marginal seat sections to further define the mouth of the bedpan liner, the marginal seat sections, in the open position of the mouth, being adapted to overlie at least part of the seat portion of a bedpan; and a second handle means connected adjacent the other of said open ends so that when being positioned on a bedpan one handle of said pair of handles can be put into substantial alignment with said second handle means, and when the sleeve is folded over on itself and the first and second handle means are brought and held together, a purse-like structure is provided with the thus folded over sleeve forming a pouch for containing waste matter, and wherein release of said second handle means allows the sleeve to unfold and the waste matter to pass outwardly through said other of the open ends.

2. The structure of claim 1 wherein each of the marginal set sections is generally C-shaped, and wherein said seat sections are hingedly connected together to define, in the open position, a generally oval outline shape.

3. The structure according to claim 1 or 2 wherein said second handle means is connected to said sleeve immediately adjacent said other open end, the sleeve including a flap which extends outwardly of said other open end in overlapping relation to said second handle means thereby to protect the latter from contact with waste matter passing outwardly of the other open end.

4. The structure according to claim 1 or 2 wherein said sleeve includes a plurality of pleats therein extending from said mouth toward the other open end whereby to allow the sleeve to bellow outwardly into the interior of a bedpan when in use.

5. The structure according to claim 1 or 2 wherein said sleeve is tapered downwardly in size from the mouth toward said other open end.

6. The structure according to claim 1 or 2 wherein said pair of handles are formed integrally with their associated marginal seat sections from a relatively thick flexible sheet plastic material, that surface of the sheet material which comes into contact with a patient being smooth while the other surface is roughened to resist slippage relative to the bedpan when in use.

7. The structure according to claim 1 or 2 wherein said sleeve is made from a relatively thin pliable plastic sheet.

8. A package comprising the structure of claim 1 or 2 in combination with a paper liner disposed within said sleeve to allow solid waste to slide out of the sleeve without sticking thereto.

9. The structure according to claim 1 or 2 wherein said second handle means is connected to said sleeve immediately adjacent said other open end, the sleeve including a flap which extends outwardly of said other open end in overlapping relation to said second handle means thereby to protect the latter from contact with waste matter passing outwardly of the other open end, wherein said sleeve includes a plurality of pleats therein extending from said mouth toward the other open end whereby to allow the sleeve to bellow outwardly into the interior of a bedpan when in use.

10. The structure according to claim 1 or 2 wherein said second handle means is connected to said sleeve immediately adjacent said other open end, the sleeve including a flap which extends outwardly of said other open end in overlapping relation to said second handle means thereby to protect the latter from contact with waste matter passing outwardly of the other open end, wherein said sleeve includes a plurality of pleats therein extending from said mouth toward the other open end whereby to allow the sleeve to bellow outwardly into the interior of a bedpan when in use, wherein said sleeve is tapered downwardly in size from the mouth toward said other open end.

11. The structure according to claim 1 or 2 wherein said second handle means is connected to said sleeve immediately adjacent said other open end, the sleeve including a flap which extends outwardly of said other open end in overlapping relation to said second handle means thereby to protect the latter from contact with waste matter passing outwardly of the other open end, wherein said sleeve includes a plurality of pleats therein extending from said mouth toward the other open end whereby to allow the sleeve to bellow outwardly into the interior of a bedpan when in use, wherein said sleeve is tapered downwardly in size from the mouth toward said other open end, wherein said pair of handles are formed integrally with their associated marginal seat sections from a relatively thick flexible sheet plastic material, that surface of the sheet material which comes into contact with a patient being smooth while the other surface is roughened to resist slippage relative to the bedpan when in use.

12. The structure according to claim 1 or 2 wherein said pair of handles are formed integrally with their associated marginal seat sections from a relatively thick flexible sheet plastic material and said sleeve is made from a relatively thin pliable plastic sheet.

* * * * *